US011344137B1

(12) United States Patent
Jaffre et al.

(10) Patent No.: US 11,344,137 B1
(45) Date of Patent: May 31, 2022

(54) CONVERTIBLE INFANT SEAT

(71) Applicant: Aden & Anais, Inc., New York, NY (US)

(72) Inventors: Alexis Jaffre, Brooklyn, NY (US); Grace Galapo, New York, NY (US); Sharon Gillett, Silver Creek, WA (US)

(73) Assignee: ADEN & ANAIS, INC., New York, NY (US)

( * ) Notice: Subject to any disclaimer, the term of this patent is extended or adjusted under 35 U.S.C. 154(b) by 0 days.

(21) Appl. No.: 17/172,896

(22) Filed: Feb. 10, 2021

(51) Int. Cl.
*A47D 1/08* (2006.01)
*A47D 13/10* (2006.01)
*A47D 15/00* (2006.01)

(52) U.S. Cl.
CPC ..... *A47D 1/08* (2013.01); *A47D 13/102* (2013.01); *A47D 13/107* (2013.01); *A47D 15/00* (2013.01)

(58) Field of Classification Search
CPC ..... A47D 1/08; A47D 13/102; A47D 13/107; A47D 15/00
USPC ..... 297/118, 132, 131
See application file for complete search history.

(56) References Cited

U.S. PATENT DOCUMENTS 226,345 A * 4/1880 Paine ..... A47D 1/004 297/132
3,331,631 A * 7/1967 Pierson, Jr. ..... A47D 13/107 297/259.4
5,887,945 A * 3/1999 Sedlack ..... A47D 13/10 297/296
6,676,210 B1 * 1/2004 Peyton ..... A47C 31/11 297/219.12
2011/0260507 A1 * 10/2011 Parness ..... A47D 15/006 297/118

FOREIGN PATENT DOCUMENTS

CN 111870082 A * 11/2020
FR 1113279 A * 3/1956 ..... A47D 1/08

* cited by examiner

*Primary Examiner* — Milton Nelson, Jr.
(74) *Attorney, Agent, or Firm* — Middleton Reutlinger

(57) ABSTRACT

An infant seat is convertible between at least a rocking configuration and a chair configuration. The infant seat includes a seat for supporting an infant and a base supporting the seat. The base includes a rocker member with first and second portions pivotally coupled to one another by a hinge, where each of the first and second portions include a curved rocking surface. The second portion is pivotable about the hinge between first and second positions relative to the first portion. In the first position, the curved rocking surface of the second portion is adjacent to the curved rocking surface of the first portion to support the base on a floor and permit rocking of the base on the floor. In the second position, the second portion extends between the seat and the floor to support the seat and inhibit rocking of the base.

20 Claims, 10 Drawing Sheets

CONVERTIBLE INFANT SEAT

BACKGROUND

Seats for supporting an infant in various positions come in variety of forms, such as rockers, bouncers, chairs, etc. Conventionally, each of these seats is sold separately, each performing only a single function and each taking valuable floor space in a home. Although some combination seats that perform multiple functions (e.g. a rocker/bouncer combination seat) are known, these combination seats are often quite large and bulky and have a large footprint. Additionally, these combination seats often do not easily and compactly fold for storage. Therefore, a need continues for a combination infant seat capable of multiple functions that may be easily collapsed into a storage position.

SUMMARY

The herein-described embodiments address these and other problems associated with the art by providing a convertible infant seat that may be converted to a variety of use configurations (e.g. a rocker configuration, a chair configuration, and/or a bouncer configuration), as well as a storage configuration.

Therefore, consistent with one aspect of the invention, a convertible infant seat includes a seat for supporting an infant and a base supporting the seat; where the base includes a rocker member with first and second portions pivotally coupled to one another by a hinge, the first and second portions each having a curved rocking surface and the second portion being pivotable about the hinge between first and second positions relative to the first portion. In the first position, the curved rocking surface of the second portion is adjacent to the curved rocking surface of the first portion to support the base on a floor and permit rocking of the base on the floor, and in the second position, the second portion extends between the seat and the floor to support the seat and inhibit rocking of the base.

In some embodiments, the rocker member is a first rocker member and the convertible infant seat further includes a second rocker member. In some such embodiments, the convertible infant seat may additionally include a front support positioned generally transverse to and connecting the first rocker member and the second rocker member at respective first ends of the first and second rocker members. In some embodiments, the infant seat may also include at least one support leg coupled to the front support and movable between a use position and a storage position, where in the use position, the support leg extends generally downward from the front support to make contact with the floor and inhibit rocking of the base, and where in the storage position the support leg is positioned to enable rocking of the base. In some such embodiments, when the first and second rocking members are in the first position and the support leg is in the use position, rocking of the base is inhibited and the infant seat is in a bouncer configuration.

In some embodiments, the convertible infant seat further includes a spring portion extending from a first and a second side of the seat to the base to support the seat. In some embodiments, the hinge is offset from a second end of the first portion of the rocking member. In other embodiments, the hinge is offset from a first end of the second portion of the rocking member. In still other embodiments, the base includes a second hinge, where the second hinge joins the spring to the base.

In some embodiments, the seat includes a latch to receive the second portion of the rocking member when the second portion extends between the seat and the floor to support the seat. In some embodiments, the base includes a holder to receive the seat when the infant seat is in the storage configuration.

In some embodiments, the convertible infant seat additionally includes a tray removably attached to the seat. In some embodiments, the seat further includes a removable fabric cover.

In another aspect, an infant seat convertible between a rocker position, a chair position, and a bouncer position, includes: a seat; a base supporting the seat, where the base includes a first and second rocker members extending generally parallel to one another and a front support positioned generally transverse to and connecting the first and second rocking members proximate respective first ends thereof, where each of the first and second rocker members include: a first portion and a second portion, and a hinge pivotally coupling the first and the second portions, where the first and second portions each include a curved rocking surface and the second portion is pivotable about the hinge between first and second positions relative to the first portion; a spring portion extending from first and second sides of the seat to the base to support the seat; and one or more support legs coupled to a front portion of the base; where in the rocker position, the first and second rocking members are in the first position and the curved rocking surface of the second portion is adjacent to the curved rocking surface of the first portion to support the base on a floor and permit rocking of the base on the floor; where in the chair position, the first and second rocking members are in the second position and the second portion extends between the seat and the floor to support the seat and inhibit rocking of the base; and where in the bouncer position, the first and second rocker members are in the first position and the one or more support legs extend generally downwardly from the front portion of the base to support the seat and inhibit rocking of the base.

In some embodiments, the support leg is coupled to the front support and movable between a use position and a storage position, where in the use position the support leg extends generally downward from the front support to make contact with the floor and inhibit rocking of the base, and where in the storage position the support leg is positioned to enable rocking of the base.

In some embodiments, the seat includes a latch to receive the second portion of the first rocking member when the second portion extends between the seat and the floor to support the seat.

In some embodiments, the hinge is offset from respective second ends of the first portions of the first and the second rocking members. In other embodiments, the hinge is offset from respective first ends of the second portions of the first and the second rocking members.

In some embodiments, the front support includes a second hinge disposed, where the second hinge joins the spring to the base. In some embodiments, the base includes a latch to receive the seat when the infant seat is in the storage configuration.

DETAILED DESCRIPTION

Figure 1:
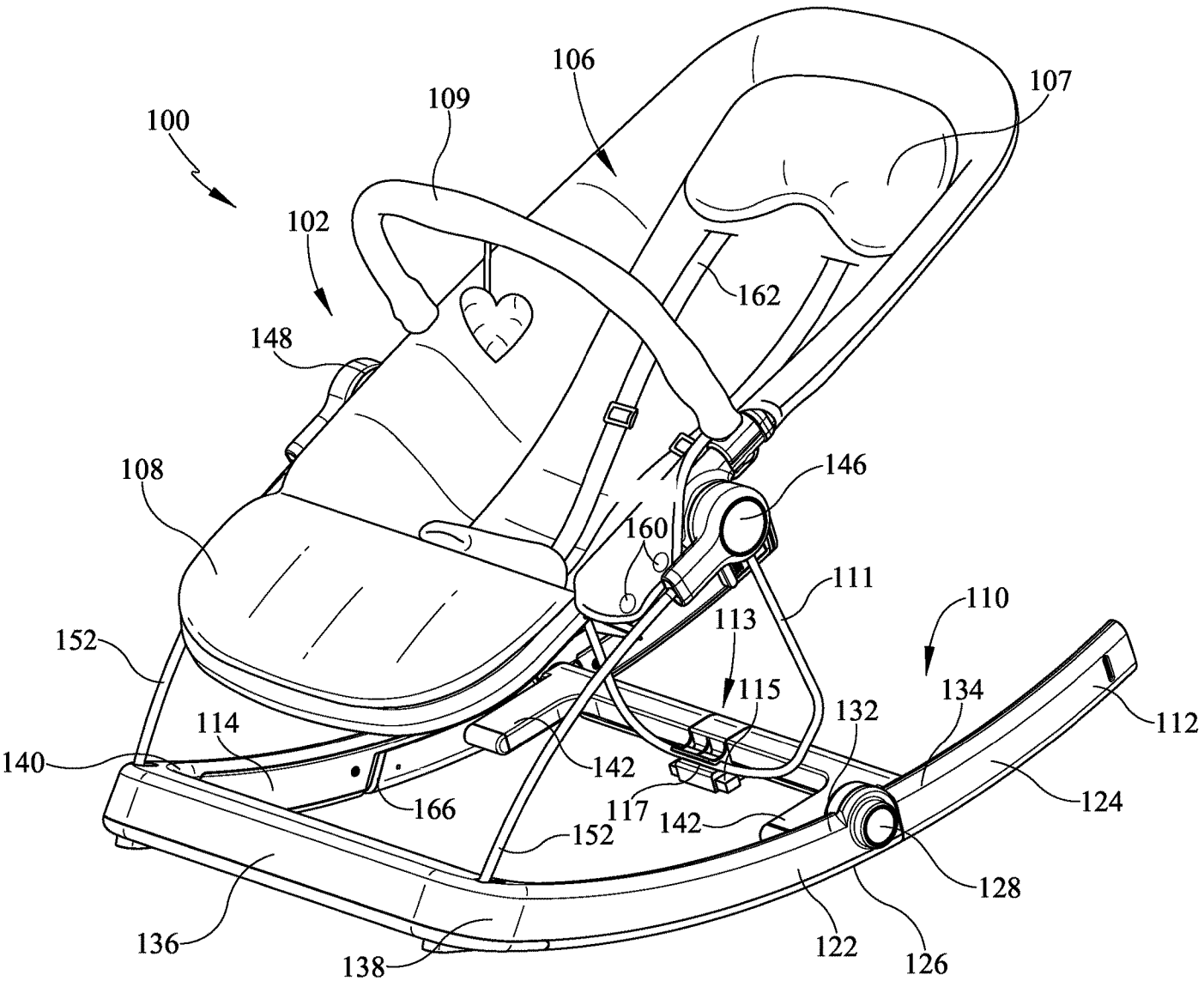
FIG. 1 is a perspective view of an example convertible infant seat in a rocker configuration consistent with some embodiments of the invention.
Figure 2:
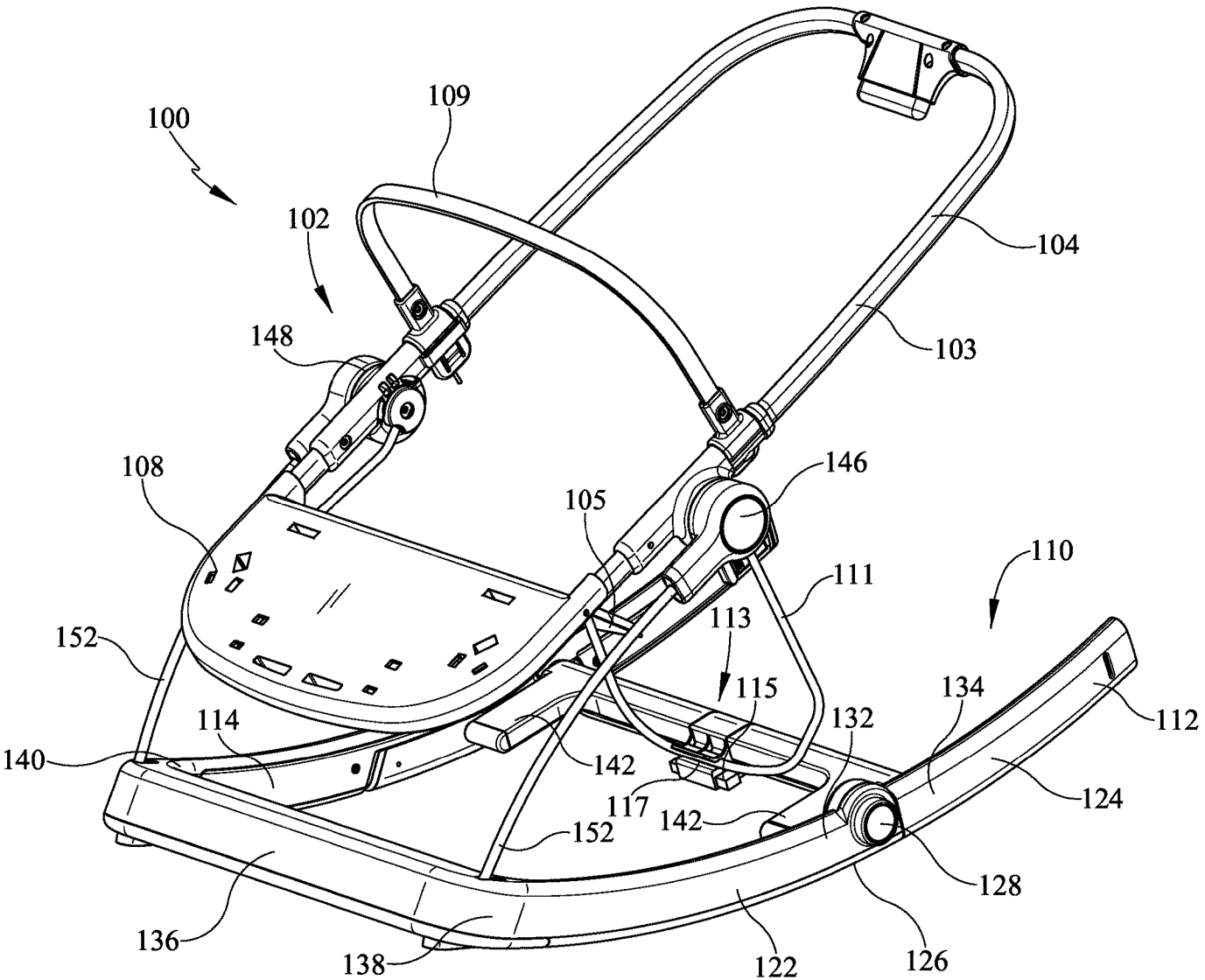
FIG. 2 is a perspective view of the convertible infant seat of FIG. 1 in a rocker configuration with the fabric cover removed.
Figure 3:
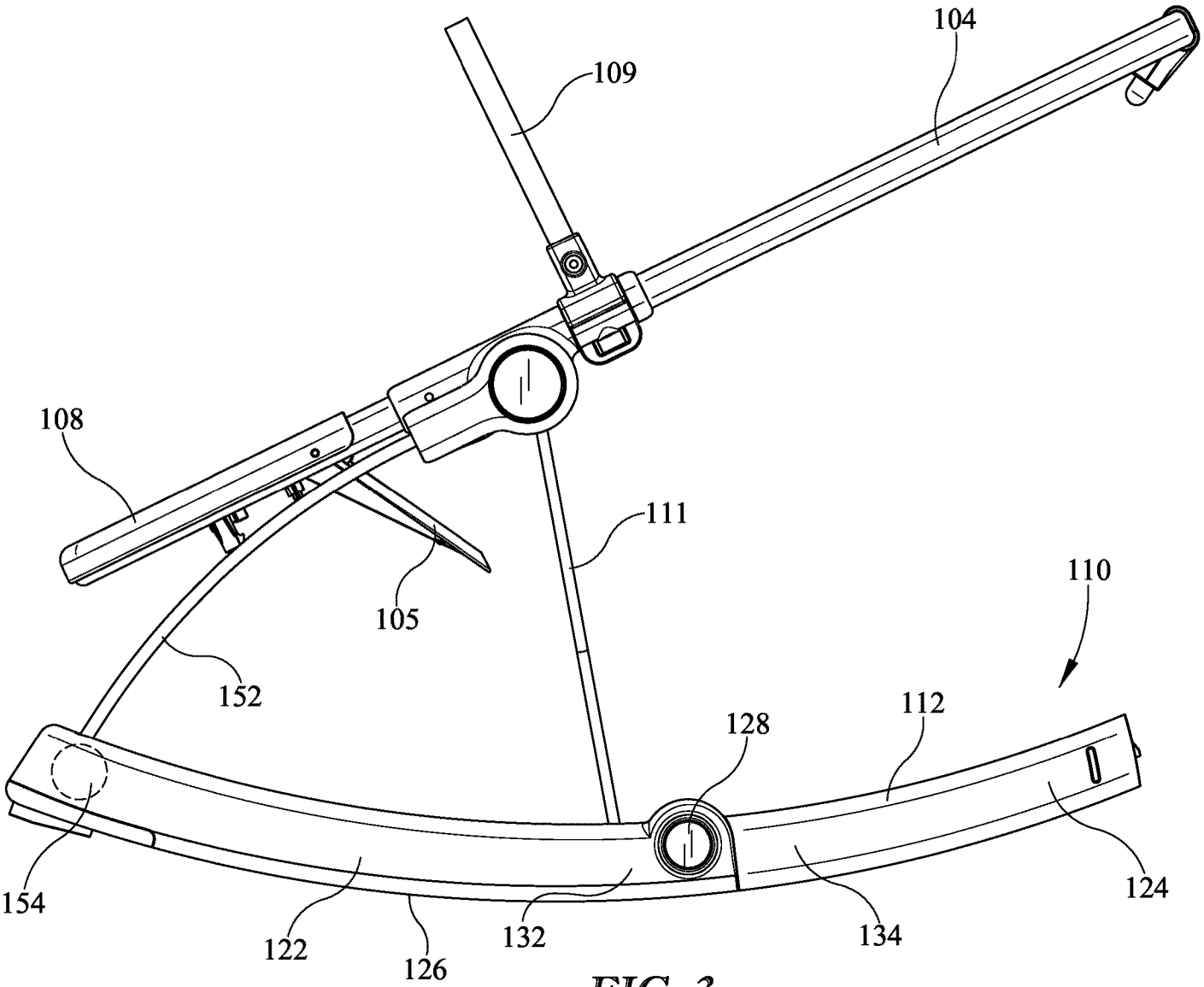
FIG. 3 is a side view of the convertible infant seat of FIG. 1 in a rocker configuration with the fabric cover removed.
Figure 4:
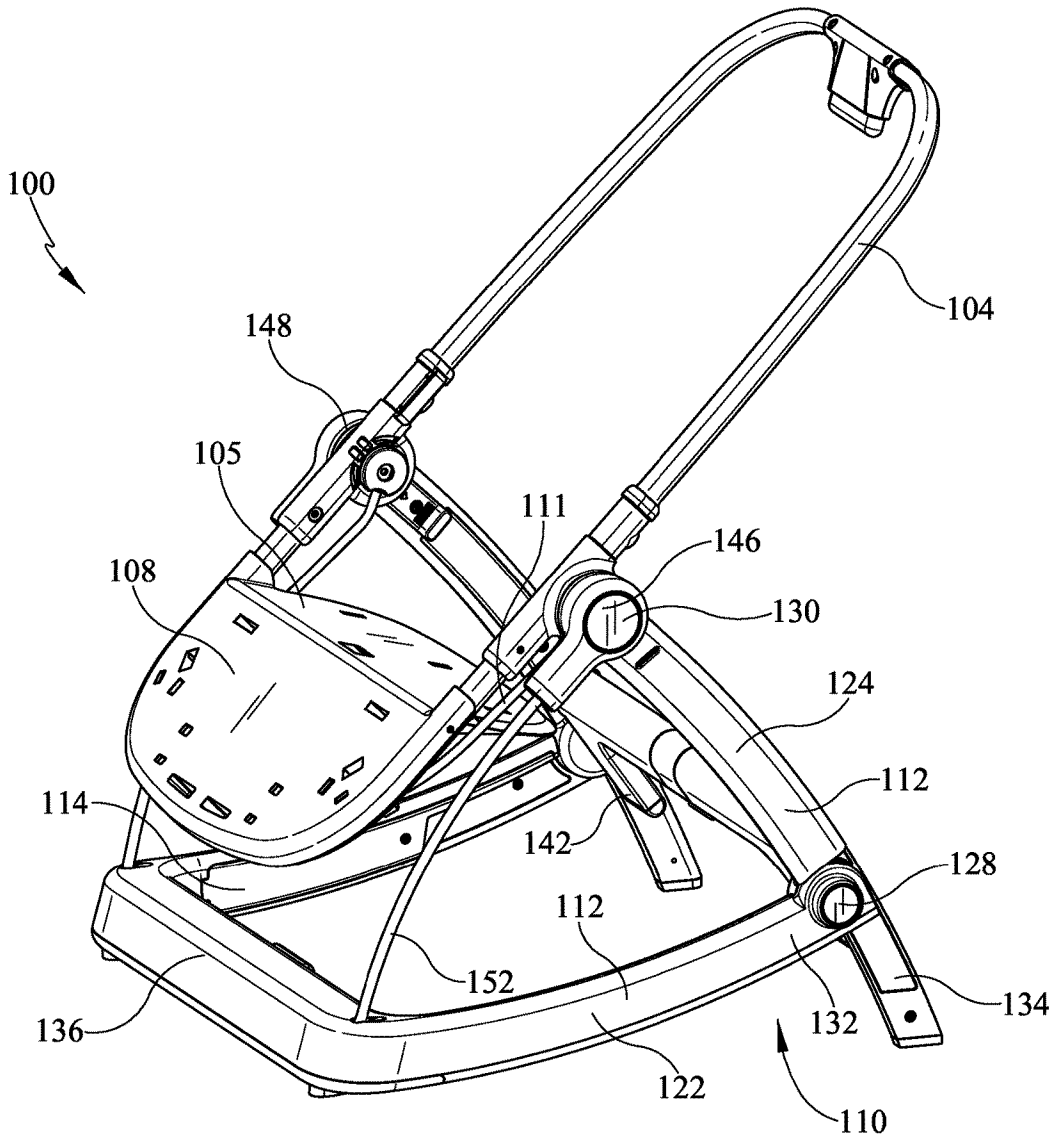
FIG. 4 is a perspective view of the convertible infant seat of FIG. 1 in a chair configuration with the fabric cover removed.
Figure 5:
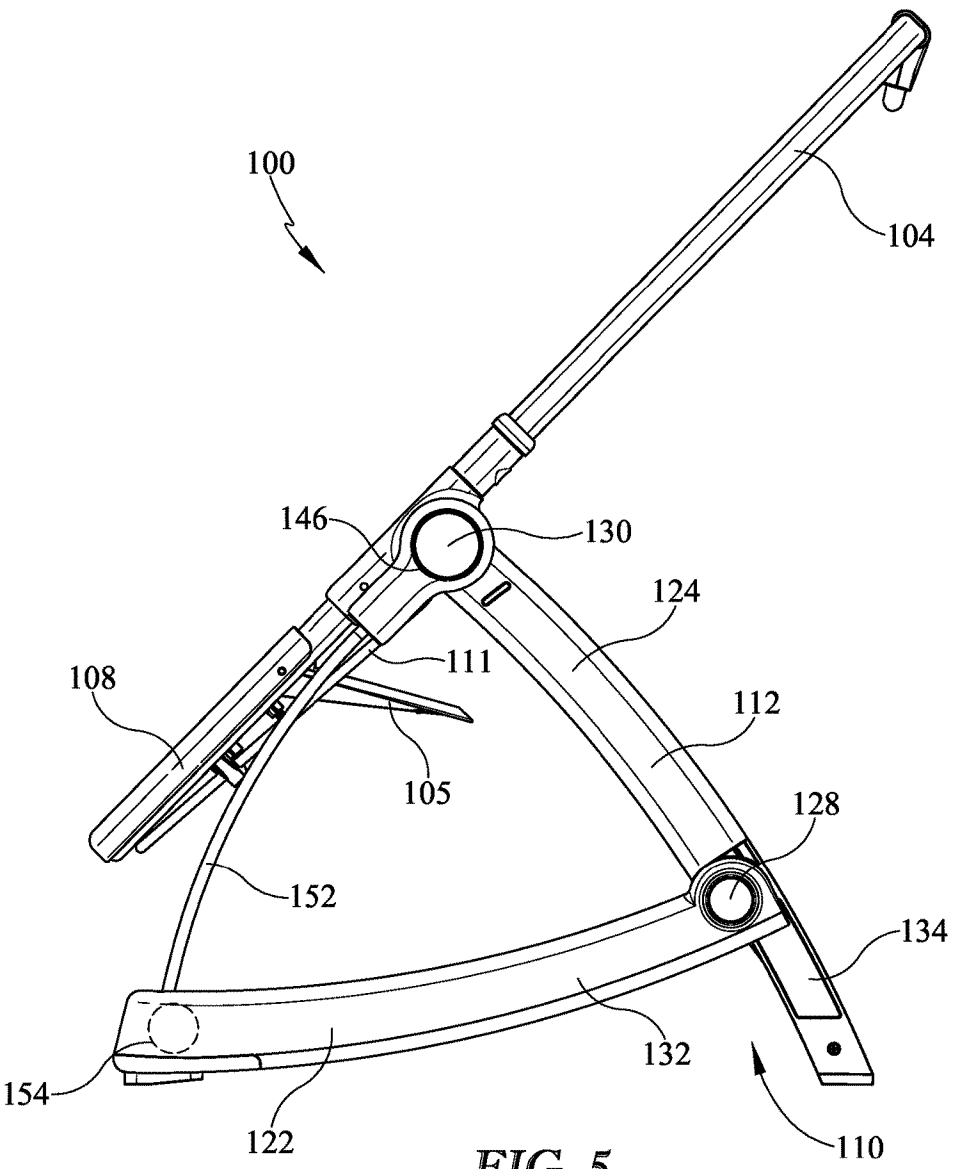
FIG. 5 is a side view of the convertible infant seat of FIG. 1 in a chair configuration with the fabric cover removed.
Figure 6:
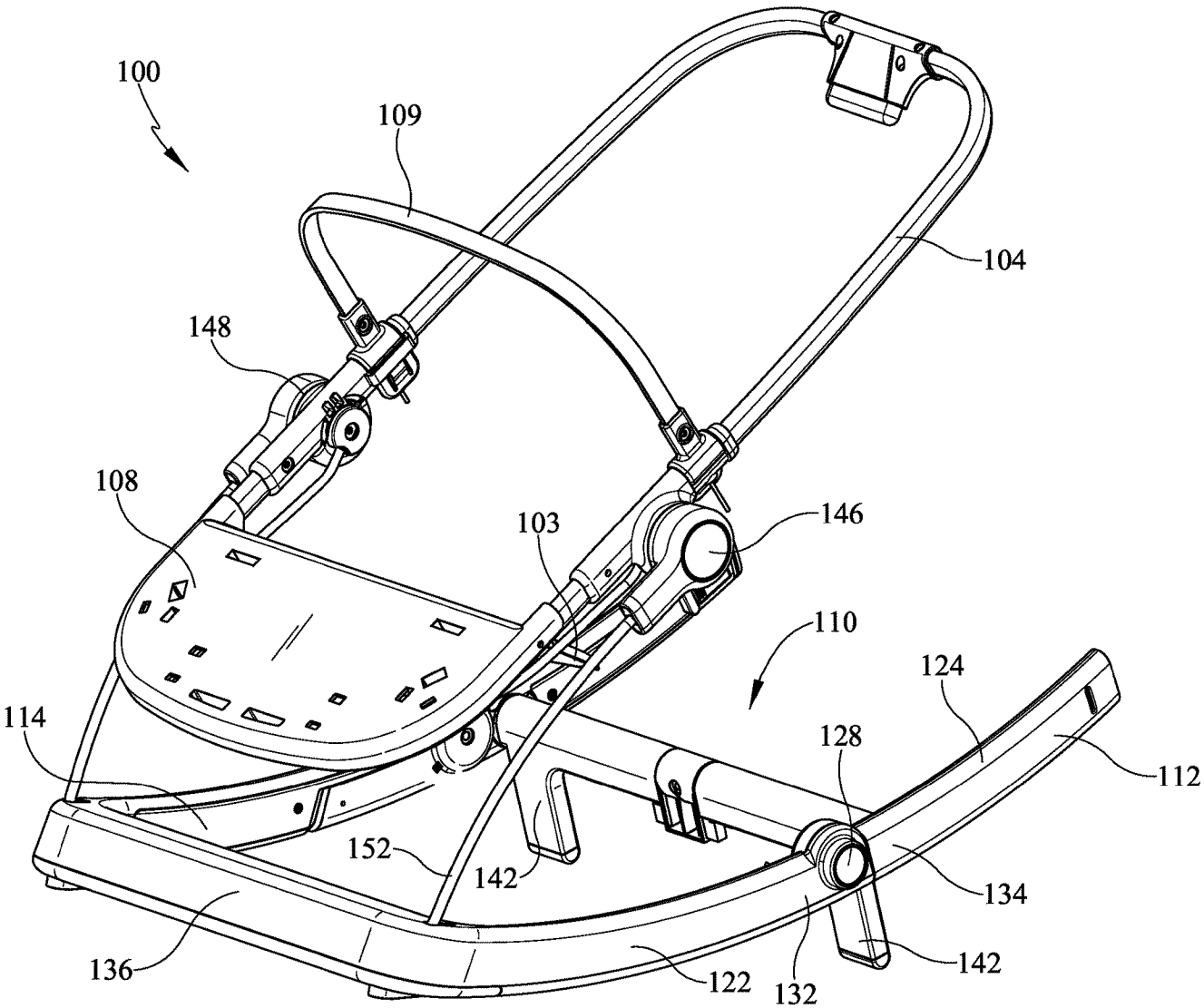
FIG. 6 is a perspective view of the convertible infant seat of FIG. 1 in a bouncer configuration with the fabric cover removed.
Figure 7:
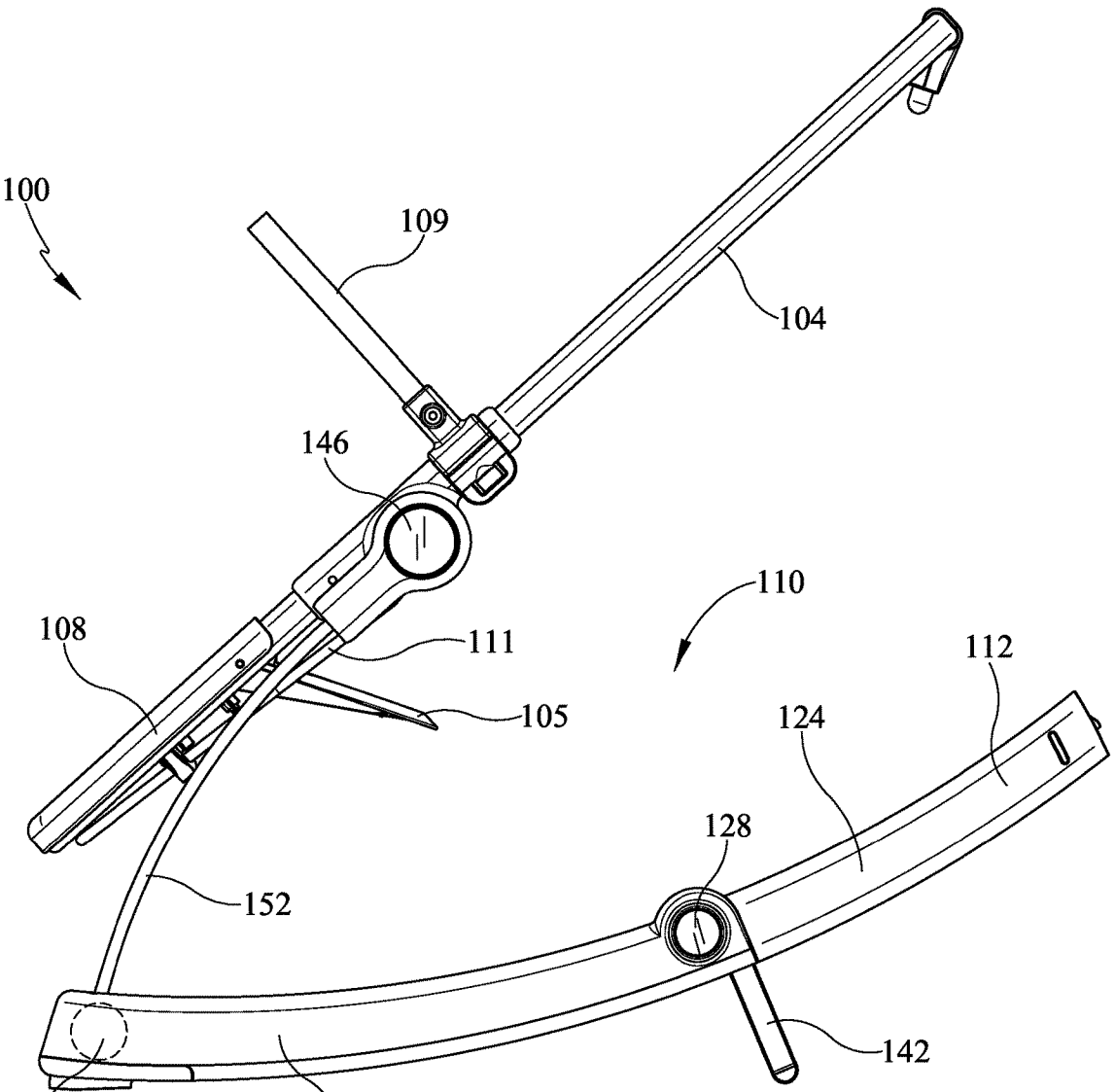
FIG. 7 is a side view of the convertible infant seat of FIG. 1 in a bouncer configuration with the fabric cover removed.
Figure 8:
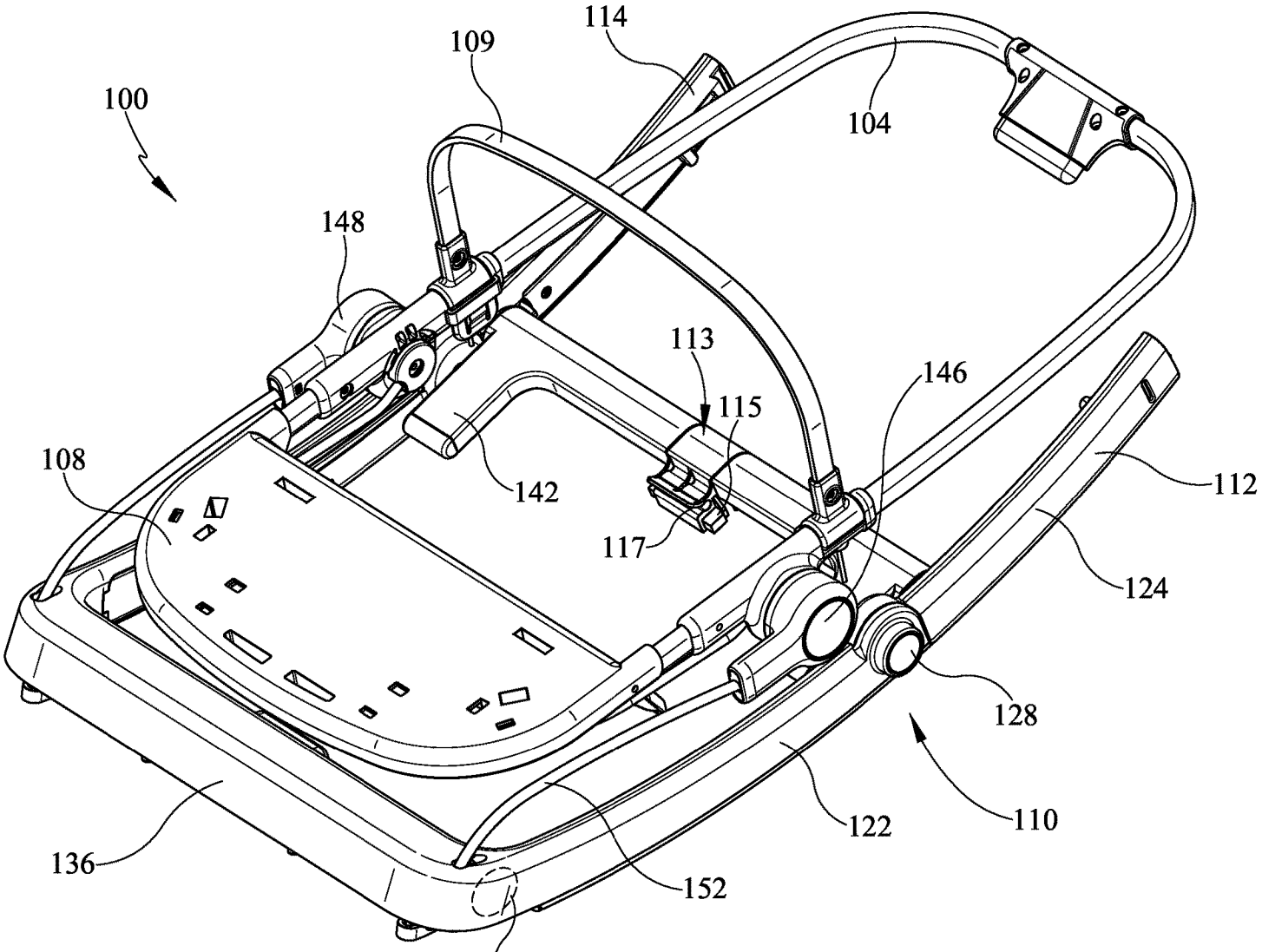
FIG. 8 is a perspective view of the convertible infant seat of FIG. 1 in a storage configuration with the fabric cover removed.
Figure 9:
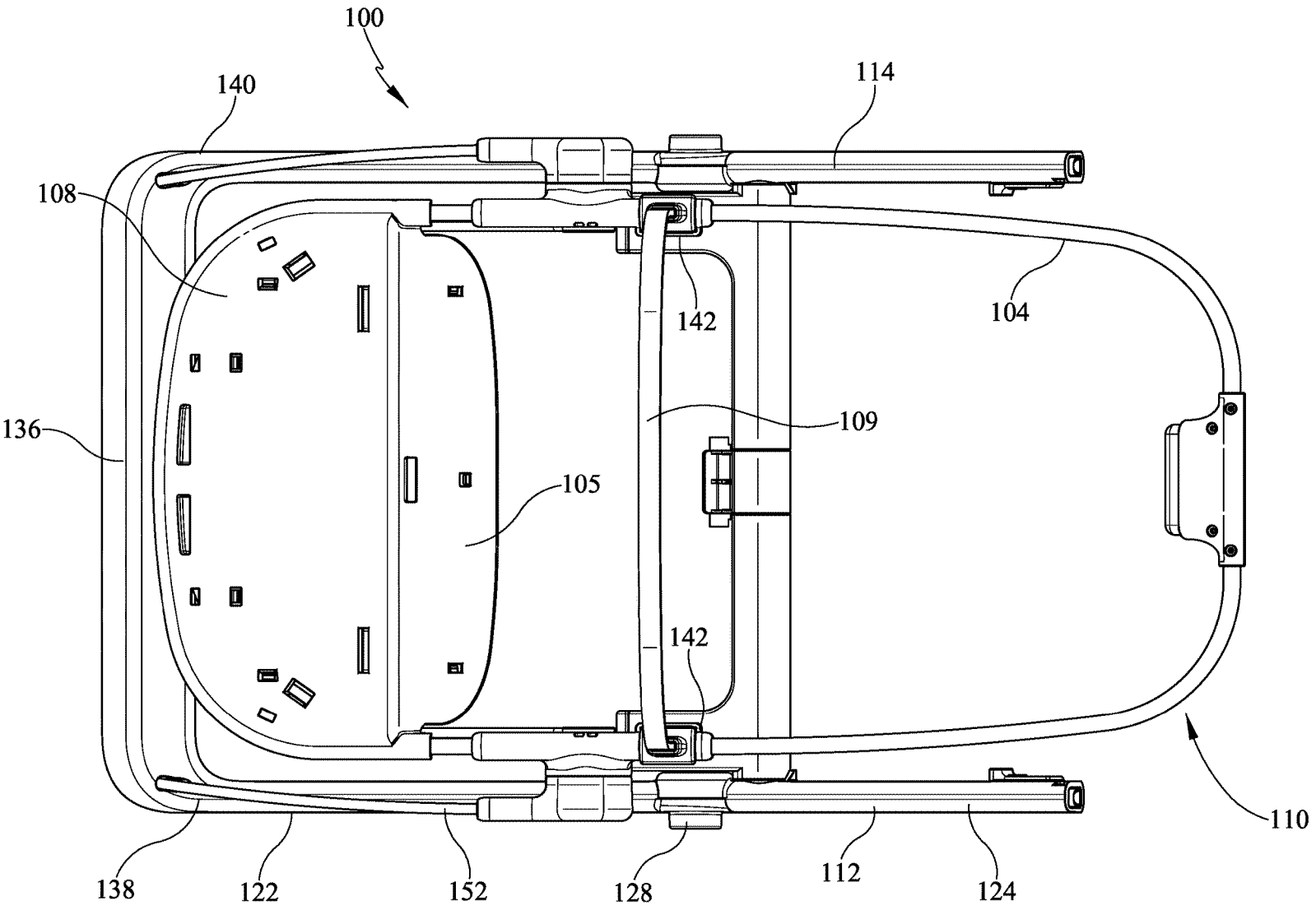
FIG. 9 is a top view of the convertible infant seat of FIG. 1 in a storage configuration with the fabric cover removed.
Figure 10:
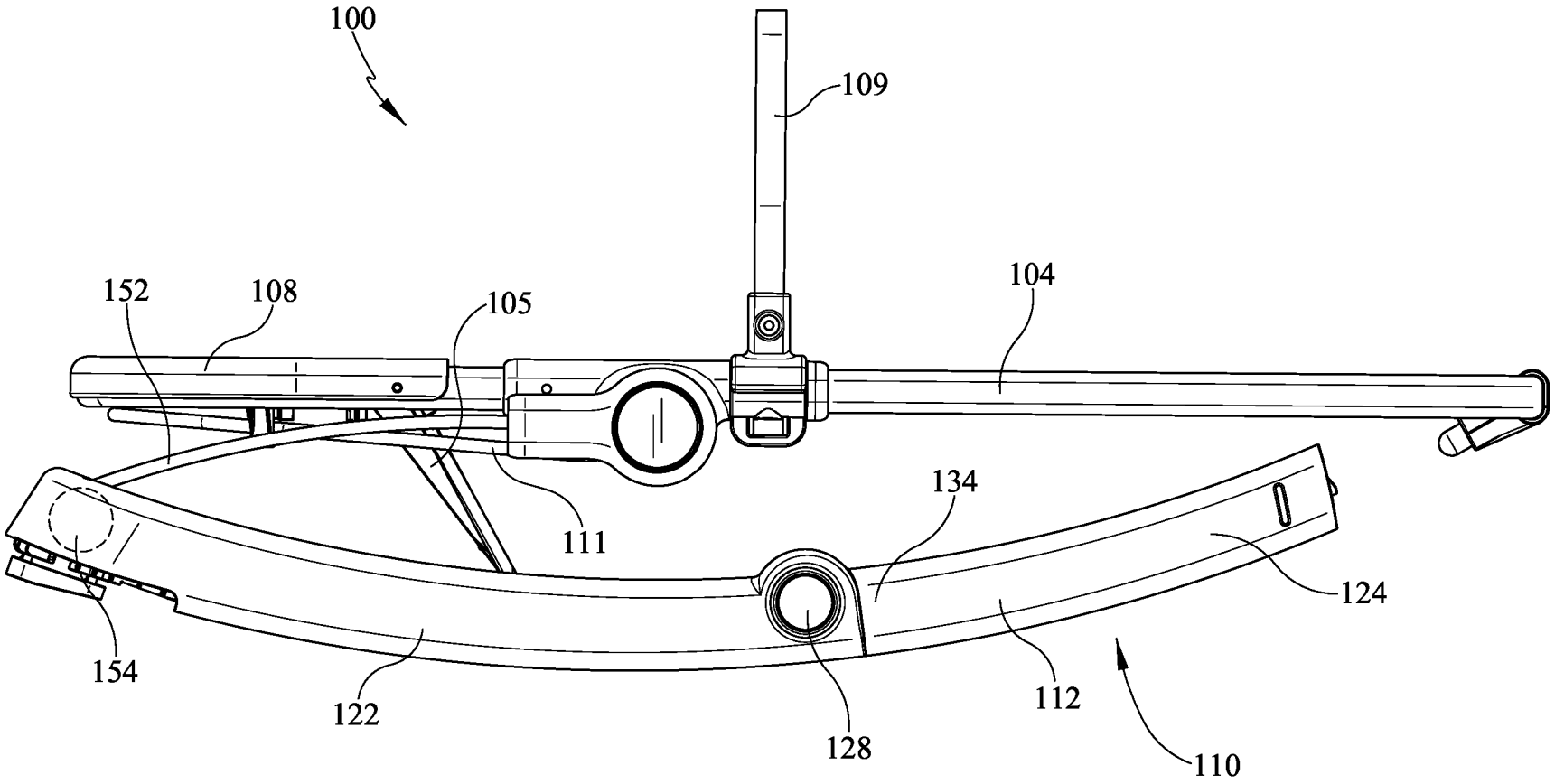
FIG. 10 is a side view of the convertible infant seat of FIG. 1 in a storage configuration with the fabric cover removed.

Turning now to the drawings, wherein like numbers denote like parts throughout the several views, FIGS. 1-3 illustrate an example convertible infant seat 100 in a rocker configuration. FIGS. 4-5 illustrate the convertible infant seat 100 in a chair configuration, FIGS. 6-7 illustrate the convertible infant seat in a bouncer configuration, and FIGS. 8-10 illustrate the convertible infant seat in storage configuration. The convertible infant seat 100 described and illustrated herein may include a seat 102 that can be used to support an infant in a variety of positions. In some instances, the seat may include a seat frame 104 with either a removable or fixed fabric cover 106. Where the fabric cover 106 is removable, the fabric cover may be affixed to the seat frame through buttons 160, snaps, hook and loop, or any number of other attachment mechanisms. The fabric cover 106 may include a harness 162 or strap for safely containing the infant in the convertible infant seat 100. The fabric cover 106 may also, in some instances, include padding for additional comfort. For example, in some instances, such as illustrated in FIG. 1, the cover may include a head support pillow 107. Where present, this head support pillow 107 may be detachable from the cover 106.

In some instances, the seat frame 104 may be a single piece structure, while in other instances, the seat frame 104 may be include multiple pieces, for example a generally vertical piece 103 for supporting the infant's upper body and spine and a generally horizontal piece 105 for supporting the infant's lower body and buttocks. In some instances, the seat and the generally horizontal piece 105 of the frame 104 may be constructed of a hard material, such as plastic. The seat may, in some instances, include a footrest portion 108. Where present, the generally horizontal piece 105 may be coupled with the footrest portion 108.

The seat frame 104 may additionally include a toy bar attachment 109. In some instances, the toy bar attachment 109 may be removably coupled to the frame 104. In such instances, the toy bar attachment 109 may be coupled to the frame through any attachment mechanism known; as a non-limiting example, it may be removably attached through a sliding latch design. The toy bar attachment 109 may include a mobile, toys, or other visually stimulating items to entertain an infant. Furthermore, as illustrated particularly in FIG. 1, the toy bar attachment 109 may be enclosed in a padded fabric.

The convertible infant seat may also include a rocker support 111. This rocker support may be a plastic, metal, or the like support bar that may extend from the first 146 and second 148 sides of the seat 102 towards a base 110 (described in detail herein). In some instances, such as illustrated in FIGS. 1-3, the rocker support 111 may couple with, or attach to, a receiving portion and lock 113, which allows the rocker support 111 further support the seat 102 when in a rocker configuration. In some instances, the rocker support 111 may rotate toward the seat 102, in particular towards the footrest portion 108 for storage when the infant seat 100 is not in a rocker configuration.

The convertible infant seat may also include a base 110 that supports the seat 102. In some instances, the base may include a single rocker member spanning a substantial portion of the width of the seat 102. In other instances, such as illustrated herein, the base may include a first rocker member 112 and a second rocker member 114, which may be positioned substantially parallel to one another. Each of the first and second rocker members 112, 114 may be constructed of two elongated pieces—a first portion 122 and second portion 124, each of which may include a curved rocking surface 126 designed for placement on the floor when in the rocking configuration (as illustrated in FIGS. 1-3). In some instances, the first and second portions 122, 124 may be constructed of wood; while in other embodiments, the first and second portions 122, 124 may be constructed of a durable plastic or any other suitable material. The curved rocking surface 126 of each portion 122, 124 may extend fully or partially along the length of the respective portion.

The first and second portions 122, 124 of the rocking member(s) 112, 114 may be pivotally coupled to one another by a hinge and lock 128. The hinge 128 may allow the second portion 124 of the rocking member(s) 112, 114 to pivot between a first position (illustrated in FIGS. 1-3) and a second position (illustrated in FIGS. 4-5). When the second portion 124 of the rocking member(s) 112, 114 is in the first position, the curved rocking surface 126 of the second portion 124 is adjacent to the curved rocking surface 126 of the first portion 122 to support the base on a floor and allow for rocking movement of the base 110 on the floor. When the curved rocking surface 126 of the first 122 and second 124 portion is in contact with a surface, for example the floor, the base is allowed to rock forward and backward, and as such, the convertible infant seat may be said to be in a rocker configuration. In some instances, the curved rocking surface 126 may additionally include a non-slip or non-skid component (e.g. felt) to minimize excess movement of the infant seat 100 when in the rocking configuration.

In some instances, a second end 132 of the first portion 122 of the rocking member(s) 112, 114 and a first end 134 of the second portion 124 may be narrower than the remaining portions of the rocking member(s) 112, 114. This narrowing may allow the second end 132 of the first portion 122 of and the first end 134 of the second portion 124 to overlap each other when the convertible infant seat is in the rocker (see FIGS. 1 and 2), bouncer (see FIG. 6) or storage (see FIG. 8) configuration. In some instances, the first portion may also include a stop that engages the second portion to limit rotation beyond the rocking position, resulting in a continuous curved surface 126. For example, as illustrated herein, a stop in some embodiments may be formed by an angled surface 166 that mates with the end surface of second portion 124. Additionally, as best illustrated in FIGS. 4 and 5, the first portion 122 may also include a lock 128, detent, or similar structure. This lock 128, detent, or similar structure may hold the first and second portions 122, 124 of the rocking member(s) 112, 114 in the curved (non-pivoted) position when in the convertible infant seat 100 is in the rocker configuration or the bouncer configuration.

As described, the hinge 128 may allow the second portion 124 of the rocking member(s) 112, 114 to be pivotable between a first position (illustrated in FIGS. 1-3) and a second position (illustrated in FIGS. 4-5). In some instances, this may include pivoting the second portion 124 upward toward the seat 102 so that the second portion extends between the seat 102 and the floor. In such a position, rocking is inhibited and the convertible infant seat may be said to be in a chair configuration. In some instances, the seat may include a latch 130 or receiving portion configured to receive the second portion 124 of the rocking member 112, 114 when the second portion 124 is pivoted upward to extend between the seat 102 and the floor. The latch may additionally include a lock for locking the convertible infant seat into the chair configuration. Furthermore, the latch, where present, provides additional support to the seat 102, stabilizes the seat 102, and minimizes movement.

In some instances, the hinge 128 may be offset from a second end 132 of the first portion 122 of the rocking member(s) 112, 114. In other instances, the hinge 128 may be offset from a first end 134 of the second portion 124 of the rocking members 112, 114. In still other instances, the hinge 128 may be offset from both the second end 132 of the first portion 122 of the rocking member(s) 112, 114 and the first end 134 of the second portion 124 of the rocking member(s) 112, 114. As illustrated FIGS. 4-5, the offset nature of the hinge 128 may elevate the second end 132 of the first portion 122 to facilitate the stabilization of the convertible infant seat 100 in the chair configuration. The hinge 128 may be any type of hinge known in the art, for example a pivot hinge, offset pivot hinge, etc.

When in a chair configuration, there may be no movement of the convertible infant seat 100. The convertible infant seat 100 may be placed on the floor or other surface and an infant placed in the seat 102. In some instances, the convertible infant seat 100 may also include a tray (not illustrated), for example for toys, etc. that is removably attached to the seat 102. In some instances, the base 110 of the convertible infant seat 100 may additionally include a front support 136 that is positioned between the first end 138 of the first rocking member 112 and the first end 140 of the second rocking member 114. This front support 136, where present, may facilitate the stabilization of the convertible infant seat 100 in use configurations (e.g. the rocker configuration, the chair configuration, and the bouncer configuration). In some instances, the front support 136 may be constructed of the same material as the rocking member(s) 112, 114, for example of wood or a durable plastic. In other instances, the front support 136 may be constructed of a different material as the rocking member(s) 112, 114. The rocking member(s) 112, 114, may in some instances, additionally include one or more support legs 142. Such a support leg 142 may be movable between a storage position (see FIGS. 1-5 and 8-10) and a use position (see FIGS. 6-7). In the storage position, the support leg 142 may be pivoted upward toward the seat 102 to align with the rocking member(s) 112, 114 for storage. In the use position, the support leg 142 may be pivoted downward away from the rocking member(s) 112, 114 to make contact with the floor. When in the use position, the support leg 142 may aid in stabilizing the convertible infant seat 100 and minimize movement of the rocking member(s) 112, 114. This may be desired, for example, when the convertible infant seat 100 is in a bouncer configuration, such as illustrated in FIGS. 6 and 7. In some instances, the convertible infant seat 100 may additionally include an additional lock 113 with an internal mechanism for keeping the support leg(s) 142 in place. A user may actuate one or more buttons 115, releases, etc. to facilitate the rotation of the support legs 142 from storage positon to use positon and vice versa. Additionally, this lock 113 may include an opening 117 for receiving and securing the rocker support 111.

In some instances, the support leg 142 may additionally include a non-slip or non-skid surface, such as rubber, to minimize movement when the support leg 142 is in a use position. Non-slip or non-skid surfaces may, in some instances, also be present on the front support 136, the first end 138 of the first rocking member 112, and/or the first end 140 of the second rocking member 114. Although the support leg 142 is illustrated as being incorporated as a part of the rocking member(s) 112, 114, this is not intended to be limiting, as the support leg 142 may be coupled anywhere on the base 110. As a non-limiting example, in some instances, the support leg 142 may be incorporated as a part of the front portion 136.

FIGS. 6 and 7 illustrate the convertible infant seat 100 in a bouncer configuration. In the bouncer configuration, the rocking member(s) 112, 114 are in the first position such that the curved rocking surface 126 of the second portion 124 is adjacent to the curved rocking surface 126 of the first portion 122 to support the base on a floor. However, the rocking motion generated by the rocking member(s) 112, 114 when in the convertible infant seat 100 is in the rocker configuration may be minimized by the support leg 142, which is pivoted into a use position when in a bouncer configuration, as illustrated in FIGS. 6 and 7. The convertible infant seat 100 may also include a spring portion 152 for facilitating the bouncing motion. The spring portion 152 may be coupled to and extend from the first 146 and second 148 sides of the seat 102 to the base 110. Where present, the spring portion 152 may extend from the first 146 and second 148 sides to the front support 136. In some instances, the spring portion 152 may be constructed of a single piece, where the spring portion 152 extends from each of the first side 146 and the second side 148 of the seat 102 and underneath the front support 136, forming a generally U-shape structure. In other instances, the spring portion 152 may be constructed of a first spring portion extending from the first side 146 of the seat 102 and a second spring portion extending from the second side 148 of the seat 102. The spring portion 152, regardless of its construction, may provide additional support to the seat 102 in all use configurations, as well as provide semi-vertical, bouncing movement when the convertible infant seat 100 is in a bouncer configuration (FIGS. 6 and 7).

In some instances, the convertible infant seat 100 may be collapsed into a storage configuration. The storage configuration may, in some instances, have a slim profile for easy storage as illustrated in FIGS. 8-10. To facilitate conversion into the storage configuration, the convertible infant seat 100 may include a second hinge 154 that may be a part of the base 110. In some instances, such as illustrated herein (indicated by the broken line), the second hinge 154 may be enclosed. In other instances, (e.g. where there is no front support 136), the second hinge 154 may be disposed proximate a first end of the rocking member(s) 112, 114. In some instances, there may be multiple second hinges 154, for example one corresponding to each of the rocking members 112, 114. Regardless of number or location of the second hinge(s) 154, when actuated the second hinge(s) 154 allows the seat 102 to collapse downward towards the base 110 into a storage configuration. Once in the storage configuration, the user may hold the convertible infant seat 100 by the base 110, which may naturally keep the infant seat 100 in the storage configuration.

It will be appreciated that various additional modifications may be made to the embodiments discussed herein, and that a number of the concepts disclosed herein may be used in combination with one another or may be used separately. Therefore, the invention lies in the claims hereinafter appended.

What is claimed is:

1. A convertible infant seat, comprising:

a seat configured to support an infant;

a base supporting the seat, wherein the base includes a rocker member including a first portion and a second portion pivotally coupled to one another by a hinge, the first and second portions each including a curved rocking surface and the second portion being pivotable about the hinge between first and second positions relative to the first portion, and the second portion including a free end that is spaced apart from the hinge; and a latch configured to selectively latch together the free end of the second portion and the seat;

wherein in the first position, the curved rocking surface of the second portion is adjacent to the curved rocking surface of the first portion to support the base on a floor and permit rocking of the base on the floor and with the free end of the second portion and the seat unlatched from one another; and wherein in the second position, the second portion extends between the seat and the floor to support the seat and inhibit rocking of the base with the free end of the second portion and the seat latched together by the latch.

2. The convertible infant seat of claim 1, wherein the rocker member is a first rocker member and the convertible infant seat further includes a second rocker member.

3. The convertible infant seat of claim 2 further comprising:

a front support positioned generally transverse to and connecting the first rocker member and the second rocker member at respective first ends of the first and second rocker members.

4. The convertible infant seat of claim 1, further comprising:

at least one support leg coupled to the base and movable between a use position and a storage position, wherein in the use position, the at least one support leg extends generally downward from the base to make contact with the floor and inhibit rocking of the base, and wherein in the storage position the at least one support leg is positioned to enable rocking of the base.

5. The convertible infant seat of claim 4, wherein when the first and second portions of the rocker member are in the first position and the at least one support leg is in the use position, rocking of the base is inhibited and the seat is in a bouncer configuration.

6. The convertible infant seat of claim 1 further comprising:

a spring portion extending from a first and a second side of the seat to the base to support the seat.

7. The convertible infant seat of claim 6, wherein the base further includes a second hinge, wherein the second hinge joins the spring portion to the base, and wherein the second hinge is pivotable to a position that collapses the convertible infant seat into a storage configuration.

8. The convertible infant seat of claim 1, wherein the hinge is offset from a second end of the first portion of the rocker member.

9. The convertible infant seat of claim 1, wherein the hinge is offset from a first end of the second portion of the rocker member.

10. The convertible infant seat of claim 1, wherein the seat further includes a removable fabric cover.

11. The convertible infant seat of claim 1 further comprising a toy bar removably attached to the seat.

12. A convertible infant seat, comprising:

a seat configured to support an infant;

a base supporting the seat, wherein the base includes a rocker member including a first portion and a second portion pivotally coupled to one another by a hinge, the first and second portions each including a curved rocking surface and the second portion being pivotable about the hinge between first and second positions relative to the first portion;

wherein in the first position, the curved rocking surface of the second portion is adjacent to the curved rocking surface of the first portion to support the base on a floor and permit rocking of the base on the floor;

wherein in the second position, the second portion extends between the seat and the floor to support the seat and inhibit rocking of the base; and at least one support leg coupled to the base and movable between a use position and a storage position;

wherein in the use position, the at least one support leg extends generally downward from the base to make contact with the floor and inhibit rocking of the base;

wherein in the storage position the at least one support leg is positioned to enable rocking of the base; and wherein when the first and second portions of the rocker member are in the first position and the at least one support leg is in the use position, rocking of the base is inhibited and the seat is in a bouncer configuration.

13. An infant seat convertible between a rocker position, a chair position, and a bouncer position, comprising:

a seat;

a base supporting the seat, wherein the base includes a first and second rocker members extending generally parallel to one another and a front support positioned generally transverse to and connecting the first and second rocker members proximate respective first ends thereof, wherein each of the first and second rocker members include:

a first portion and a second portion, and a hinge pivotally coupling the first and the second portions, wherein the first and second portions each include a curved rocking surface and the second portion is pivotable about the hinge between a first position and a second position relative to the first portion;

a spring portion extending from first and second sides of the seat to the base to support the seat; and one or more support legs coupled to the base;

wherein in the rocker position, the first and second rocker members are in the first position and the curved rocking surface of the second portion is adjacent to the curved rocking surface of the first portion to support the base on a floor and permit rocking of the base on the floor;

wherein in the chair position, the first and second rocker members are in the second position and the second portion extends between the seat and the floor to support the seat and inhibit rocking of the base; and wherein in the bouncer position, the first and second rocker members are in the first position and the one or more support legs extend generally downwardly from the base to support the seat and inhibit rocking of the base.

14. The infant seat of claim 13, wherein the one or more support legs are coupled to the first and second rocker members and movable between a use position and a storage position, wherein in the use position the one or more support legs extend generally downward from the front support to make contact with the floor and inhibit rocking of the base, and wherein in the storage position the one or more support legs are positioned to enable rocking of the base.

15. The infant seat of claim 13, wherein the seat includes a latch to receive the second portion of the first rocker member when the second portion of the first rocker member extends between the seat and the floor to support the seat.

16. The infant seat of claim 13, wherein the hinge is offset from respective second ends of the first portions of the first and the second rocker members.

17. The infant seat of claim 13, wherein the hinge is offset from respective first ends of the second portions of the first and the second rocker members.

18. The infant seat of claim 13, wherein the front support includes a second hinge, wherein the second hinge joins the spring portion to the base, and wherein the second hinge is pivotable to a position that collapses the infant seat into a storage configuration.

19. A convertible infant seat, comprising:

a seat configured to support an infant;

a base supporting the seat, wherein the base includes a rocker member including a first portion and a second portion pivotally coupled to one another by a hinge, the first and second portions each including a curved rocking surface and the second portion being pivotable about the hinge between first and second positions relative to the first portion;

wherein in the first position, the curved rocking surface of the second portion is adjacent to the curved rocking surface of the first portion to support the base on a floor and permit rocking of the base on the floor;

wherein in the second position, the second portion extends between the seat and the floor to support the seat and inhibit rocking of the base; and a spring portion extending from a first and a second side of the seat to the base to support the seat.

20. The convertible infant seat of claim 19, wherein the base further includes a second hinge, wherein the second hinge joins the spring portion to the base, and wherein the second hinge is pivotable to a position that collapses the convertible infant seat into a storage configuration.

* * * * *